US007147539B1

(12) United States Patent
Hao et al.

(10) Patent No.: US 7,147,539 B1
(45) Date of Patent: Dec. 12, 2006

(54) HEAD PERFORMANCE BASED NANO-MACHINING PROCESS CONTROL FOR STRIPE FORMING OF ADVANCED SLIDERS

(75) Inventors: Shanlin Hao, Eden Prairie, MN (US); Jeffery K. Berkowitz, Carver, MN (US); Peter R. Goglia, Edina, MN (US)

(73) Assignee: Seagate Technology LLC, Scotts Valley, CA (US)

( * ) Notice: Subject to any disclaimer, the term of this patent is extended or adjusted under 35 U.S.C. 154(b) by 584 days.

(21) Appl. No.: 09/864,562

(22) Filed: May 23, 2001

Related U.S. Application Data

(60) Provisional application No. 60/223,927, filed on Aug. 9, 2000.

(51) Int. Cl.
*B24B 49/10* (2006.01)

(52) U.S. Cl. ..... 451/5; 451/28; 29/603.15

(58) Field of Classification Search ..... 451/5, 451/1, 8, 9, 10, 28, 55; 29/603.16
See application file for complete search history.

(56) References Cited

U.S. PATENT DOCUMENTS

| | | | | |
|---|---|---|---|---|
| 3,732,552 A | | 5/1973 | Walraven | 340/174.1 E |
| 4,065,977 A | | 1/1978 | Buzzi et al. | 74/49 |
| 4,340,956 A | | 7/1982 | Miller | 369/244 |
| 4,669,011 A | | 5/1987 | Lemke | 360/103 |
| 4,853,810 A | | 8/1989 | Pohl et al. | 360/103 |
| 5,021,906 A | | 6/1991 | Chang et al. | 360/103 |
| 5,276,573 A | | 1/1994 | Harada et al. | 360/103 |
| 5,377,058 A | | 12/1994 | Good et al. | 360/75 |
| 5,463,805 A | * | 11/1995 | Mowry et al. | 29/603.09 |
| 5,494,473 A | * | 2/1996 | Dupuis et al. | 451/1 |
| 5,722,155 A | | 3/1998 | Stover et al. | 29/603.1 |
| 5,755,612 A | | 5/1998 | Schaenzer et al. | 451/5 |
| 5,764,432 A | | 6/1998 | Kasahara | 360/75 |
| 5,951,371 A | | 9/1999 | Hao | 451/28 |
| 6,045,431 A | * | 4/2000 | Cheprasov et al. | 451/5 |
| 6,047,224 A | | 4/2000 | Stover et al. | 700/119 |
| 6,069,770 A | | 5/2000 | Cui et al. | 360/103 |
| 6,760,197 B1 | | 7/2004 | Boutaghou et al. | |

* cited by examiner

*Primary Examiner*—Robert A. Rose
(74) *Attorney, Agent, or Firm*—Kinney & Lange, P.A.

(57) ABSTRACT

The present invention is a method of using direct head electrical response signals for feedback process control. When lapping the air bearing surface of a bar of sliders, a magnetic field is applied to the air bearing surface and a bias current is applied to the reader elements. A head electrical response, such as amplitude or resistance change, is measured and is used to control the lapping device. Using a fixture which allows individual slider machining, a controller can be used to monitor the head response signal for each slider on the bar and individually control each slider on the bar so that material removal over each slider proceeds until a predetermined target stripe height is reached.

21 Claims, 5 Drawing Sheets

HEAD PERFORMANCE BASED NANO-MACHINING PROCESS CONTROL FOR STRIPE FORMING OF ADVANCED SLIDERS

CROSS-REFERENCE TO RELATED APPLICATION(S)

This application claims priority from Provisional Application No. 60/223,927, filed on Aug. 9, 2000, for "Head Performance Based Nano-machining Process Control for Stripe Forming of Advanced Sliders" by Shanlin Hao, Jeffery K. Berkowitz, and Peter R. Goglia. Provisional Application No. 60/223,927 is incorporated herein by reference.

BACKGROUND OF THE INVENTION

The present invention relates to the batch fabrication of magnetic read/write transducers, and in particular to a stripe forming process which machines the transducer to a specific stripe height target.

Magnetic read/write transducers or sliders are typically produced by using thin film deposition techniques. In a typical process, an array of sliders are formed on a common substrate or wafer. As part of the formation of the sliders, electric lapping guides (ELGs) are also formed on the wafer, along with bond pads and electrical connections which allow for inspecting and testing the sliders. Using these electrical connections, the wafer is typically optically and electrically inspected, and is then sliced to produce bars, with one row of sliders in a side-by-side pattern on each bar. The bar is then lapped at the surface that will eventually face the recording medium. The ELGs are used to control the lapping process so that a desired magneto-resistive (MR) transducer height (also referred to as the stripe height) is achieved for every slider across the bar. After lapping, an air bearing pattern is formed on each slider on the bar and the bar is diced to produce individual sliders.

In order to establish adequate performance for high efficiency MR transducing heads, it is desired to achieve the specified stripe height with a very tight tolerance control. One common practice is to use ELGs in addition to on-line bending mechanisms to form a closed-loop controlled lapping process. Because the ELGs are fabricated with the actual MR transducers during the-same wafer processing, the ELGs are used to predict the stripe height for each slider and feed that information to the lapping device control system.

During the lapping process, material is removed from the surface of the bar. As material is removed from the surface of the bar, material is likewise removed from MR elements and the ELGs attached to the bar. The ELGs have a known resistence per unit of thickness so that as the surface of the bar is lapped, the resistence of the ELG changes. The ELGs are monitored during lapping to provide feedback indicating the amount of material being removed from the bar by the lapping device. In this manner, a stripe height profile can be created for the bar based on the material removal sensed by the ELGs.

In addition to ELGs used to predict the stripe height, the lapping device also commonly includes a fixture for holding the bar in place during lapping. The bar holding fixture may include a bending mechanism which can be controlled to manipulate the bar relative to the lapping mechanism, such as by bending or deforming the bar to move portions of the bar closer to or further away from the lapping mechanism.

The stripe height variation across the bar can be minimized by using the predicted stripe height profile to control the bar fixture by adjusting the bending mechanism in response to the predicted stripe height profile.

An example of a prior art ELG can be found in U.S. Pat. No. 6,047,224, entitled, "MACHINING GUIDE FOR MAGNETIC RECORDING REPRODUCE HEADS." An example of a device for lapping a bar of sliders can be found in U.S. Pat. No. 5,951,371, entitled, "MULTI-POINT BENDING OF BARS DURING FABRICATION OF MAGNETIC RECORDING HEADS."

Data storage competition is continuously driven by fast increasing areal density, which in turn reduces the desired MR element stripe height to as small as 50 nanometers, with pressure building to even further reduce this height. The existing process control schemes using ELGs and a holder capable of bending the bar are often inadequate for achieving the desired stripe height for each slider on the bar within the tolerance required at such small dimensions.

Thus, there is a need in the art for a control scheme that enables direct head performance control during machining, which in turn provides improved slider yield capability.

BRIEF SUMMARY OF THE INVENTION

The present invention is a method of using direct head electrical response signals for feedback process control, rather than indirect parameters previously collected from ELGs. When lapping the air bearing surface of a bar of sliders, a magnetic field is applied to the air bearing surface and a bias current is applied to the reader elements. A head electrical response, such as amplitude or resistance change, is measured and is used to control the lapping device. The bar of sliders is held in a fixture which allows individual slider machining. Thus, a controller can be used to monitor the head response signal for each slider on the bar and individually control each slider on the bar so that material removal over each slider proceeds until a predetermined target stripe height is reached.

DETAILED DESCRIPTION

Figure 1:
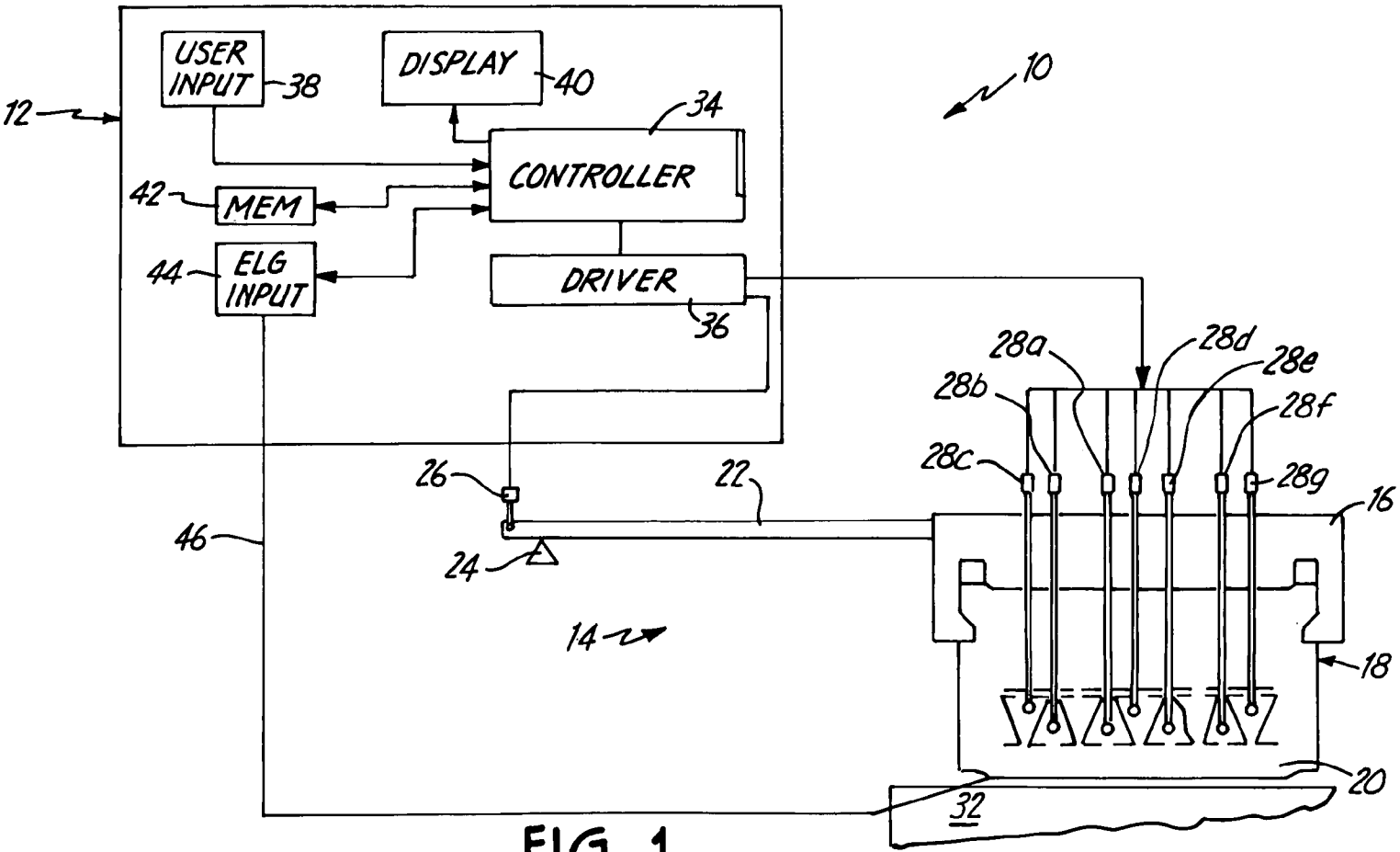
FIG. 1 PRIOR ART
FIG. 1 is a block diagram illustrating a prior art lapping system.

FIG. 1 is a simplified diagram of a prior art lapping system. The lapping system 10 comprises a control system 12 and lapping mechanism 14. The lapping mechanism 14 comprises a fixture 16 holding a carrier 18 to which is mounted a bar 20. Attached to the fixture 16 is an elongated arm 22 which is coupled to a fulcrum 24. Also attached to the arm 22 is a balancing actuator 26 which is positioned opposite the carrier 18 relative to the fulcrum 24. Located on the fixture 16 are several actuators 28*a* through 28*g* which are configured to manipulate the bar 20 such that parts of the bar 20 can be brought into contact or removed from contacting a lapping surface 32.

The control system comprises a controller 34 and driver 36. Also included as part of the control system 12 is a user input 38 and a display 40. The controller may further include a memory 42. Finally, an ELG input 44 further comprises the part of the control system 12. The controller 34 directs the driver 36 to actuate the carrier actuators 28*a* through 28*g* to position portions of the bar relative to the lapping surface 32. The controller 34 likewise directs the driver 36 to control the balancing actuator 26 which serves to control the balancing arm about fulcrum 24 such that the entire fixture 16, carrier 18, and thus bar 20 can be moved relative to the lapping surface 22. The ELG input 44 further comprises a feedback connection 46 which is in electrical connection with the electronic lapping guides carried by each of the sliders on the bar 20.

In operation, the lapping process is controlled by the control system 12. The controller 34 retrieves instructions and parameters from memory 42. Instructions and information are received from user input 38, and the status of the lapping process may be displayed on the display 40. Feedback regarding the progress of the lapping operation is received through the ELG feedback connection 46 and is provided to the controller 34 by the ELG input 44. The controller 34 responsively controls the balancing actuator 26 and carrier actuators 28*a* through 28*g* in response to the data from the ELG input 44. Thus, the lapping system 10 provides a closed loop control system in which the output from the ELG sensors are used as feedback by the controller 34 to control the actuators 28*a* through 28*g*.

Figure 2:
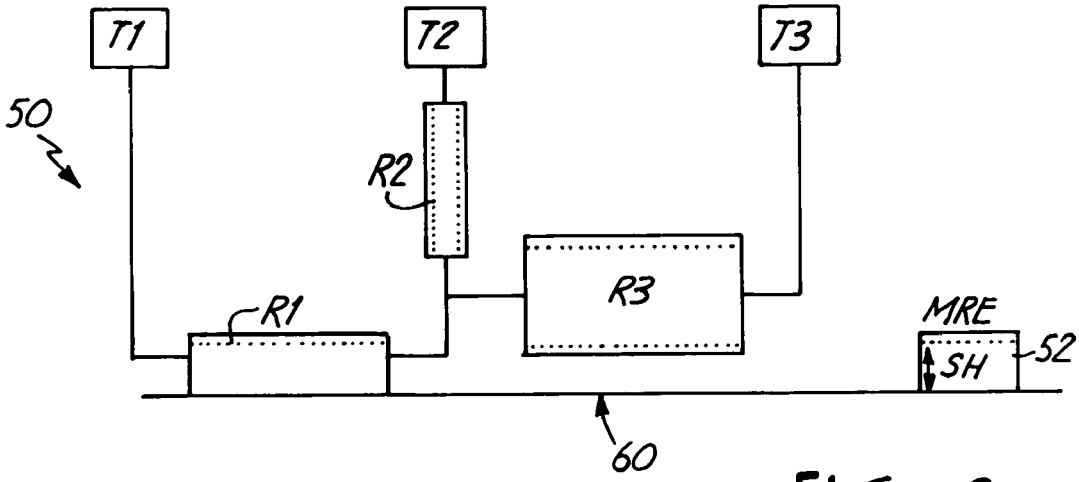
FIG. 2 PRIOR ART
FIG. 2 is a diagrammatic view of a prior art ELG design used to control the machining process to obtain the desired stripe height.

FIG. 2 is a diagrammatic view of a suitable ELG for use in the prior art lapping system described above. The ELG 50 comprises a magneto-resistive element 52, a first resistor R1, a second resistor R2, and a third resistor R3. Three terminals, T1, T2, and T3 are provided in connection with the three resistors R1, R2, R3, and though not shown in FIG. 2, the terminals T1, T2, T3 are connected to a controller in a preferred embodiment. The electric terminals T1, T2, and T3 provide the electrical connections which allow the resistances of each of the three resistors R1, R2 and R3 to be measured or determined.

First resistor R1 of the ELG 50 is preferably aligned with the MR element 52 such that the bottom surfaces of R1 and the MR element 52 lie in the same plane. This plane 60 corresponds with the air bearing surface that is lapped during the lapping process. The ELG 50 provides one method of controlling the machining of the air bearing surface 60 based on a correspondence between the height of the first resistor R1 and the height of the MR element 52. Second and third resistors R2 and R3 are reference resistors and are preferably, but not necessarily, recessed from the machine's surface.

In use, the ELG 50 functions as follows. The resistances of second and third resistors R2, R3 are measured and provide a reference resistance. Next, the sheet resistance of the layer in which the resistors R2, R3 and MR element 52 are formed is determined as a function of the reference resistances of second and third resistors R2, R3 based on a known relationship. Based on the reference resistances and the sheet resistance, along with other properties of the wafer or bar, a non-machine resistance can be calculated which corresponds to the predicted resistance for first resistor R1. After that, the resistance of first resistor R1 can be directly measured to determine an actual resistance of first resistor R1 pre-machining. The predicted non-machine resistance is then compared to the non-machine resistance to determine an amount of error. Assuming the error is within desired parameters, the bar can then be machined. During lapping, the resistance of the first resistor R1 is monitored until it reaches a desired resistance. Based on a known relationship between the height of first resistor R1 and its resistance, when the resistor R1 reaches a predetermined resistance, it is also at a desired height. Similarly, it is assumed that the desired stripe height of the MR element 52 is likewise achieved.

While the scheme illustrated by the lapping system of FIG. 1 and the ELG of FIG. 2 is successful in achieving current stripe heights, as the desired height of the MR element 52 shrinks to as small as 50 nanometers, this existing process control scheme is often inadequate for a variety of reasons. In particular, the process control capability depends very much on the ELG accuracy and the correlation between the MR element 52 and the ELG 50. Table 1 below summarizes the contributing factors for stripe height variations. The variations caused by the error sources are shown in nanometers.

TABLE 1

Stripe Height Sigma Contributing Factors (nm)

| Error Source | Stripe Height Error Contributing Factors (sigma) | Nanometers |
|---|---|---|
| Wafer | CD uniformity<br>ELG uniformity<br>stitching<br>reticle distortion<br>lens distortion | 19 |
| Mechanics | hardware<br>control<br>bar carrier<br>lapping plate<br>slicing into bars<br>mount in fixture | 14 |
| Electronics | number of ELG channels<br>sampling speed<br>noise<br>signal processing accuracy | 4 |
| Raw ELG standard deviation | | 23.9 |
| ELG Error | structure<br>lead resistance<br>corrosion | 20 |
| Metrology of the ELG | FIB/ELG repeatability and reproducibility | 12 |
| FIB ELG standard deviation | | 33.4 |
| ELG/MRE offset | colinearity<br>curve fit<br>missing ELG | 20 |
| Metrology of the MR element | FIB/MRE repeatability and reproducibility | 12 |
| Total Stripe Height standard deviation | | 38.9 |

As summarized in Table 1, sources for errors relating to achieving the desired stripe height begin with inaccuracies relating to the wafer. Both the formation of the wafer, and the subsequent processing of the wafer introduce errors which relate to the ability to accurately measure and achieve the desired stripe height of the MR element. These errors include those resulting from the formation of the wafer, such as the critical dimension uniformity of the wafer, and errors resulting from the formation of the ELGs, such as the uniformity of the ELGs. In addition, errors arise in the photolithographic processes used to create and etch the wafer when creating the features of the sliders, such as errors arising from stitching, reticle distortion, and lens distortion when applying the photolithographic mask to the wafer. When combined, these sources of error originating at the wafer can cause the stripe height to vary 19 nanometers from the target stripe height.

The mechanics of the lapping system are also an error source. In particular, inaccuracies can arise from the hardware capability, the ability to control the hardware, the carrier, the lapping plate, slicing the wafer into bars, and mounting the bars into the fixture. The error caused by the mechanics is 14 nanometers.

The electronics of the lapping system add to the over all variation in the finished stripe height as well. Error sources relating to the electronics include the number of ELG channels available during lapping, the sampling speed which can be achieved, noise, accuracy, and signal processing of the control system. The error caused by the electronics is 4 nanometers.

When combined (using the root square sum), the error cause by the wafer, the mechanics, and the electronics combine to produce a standard deviation of the raw ELG of about 23.9 nanometers.

In addition to the wafer, mechanics, and electronics, the ELG itself contributes to the stripe height error. Errors caused by the structure of the ELG, variation in the resistance of the ELG's resistors, and corrosion in the device combine to produce an error of about 20 nanometers.

Another source of error is metrology used to measure the dimensions of the ELG. A focused ion beam (FIB) is used to measure a cross section of the ELG, which creates measurement error in terms of repeatability and reproducibility. The metrology error of the ELG results in an error of about 12 nanometers.

When combined with the raw ELG standard deviation (again using the root square sum), the error from the structure of the ELG and the metrology of the ELG combine for an FIB/ELG standard deviation of 33.4 nanometers.

The MR element can add to the error of the stripe height based on two factors, the ELG and MR element offset and metrology errors. Offset refers to sliders in which the ELG is not located in the same plane as the MR element, but rather is offset by a desired distance. This offset creates errors based on colinarity issues relating to ELG and wafer formation, and curve fit issues relating to the correlation between the ELG and stripe height. Adding to this error is the fact that in certain circumstances an ELG may be non-functioning, forcing the process controller to use an ELG located even further away from the MR element in controlling the lapping system. It follows that the further along the bar the controller must go for a functioning ELG, and thus the further away the ELG is from the MR element being finished to a desired stripe height, the greater the resulting error. This offset can lead to an error of about 20 nanometers, while the error relating to measurement of the MR element leads to about 12 nanometers.

When the raw ELG standard deviation is combined with the ELG error, the ELG/MR element offset error, and the metrology error, the combined error is as high as 38.9 nanometers. If the desired stripe height is 50 nanometers, this amount is well over 50% of that goal. Thus, Table 1 underscores the factors which prevent current ELG feedback based control schemes from producing good parts with high yield for stripe heights as small as 50 nanometers.

The present invention addresses this problem by using direct head electrical response signals for feedback process control, rather than indirect feedback regarding stripe height received from an ELG. By doing so, the need for an ELG is eliminated, along with many of the errors associated with the ELG. As a result, it is possible to move toward the goal of producing high yield sliders having extremely small stripe heights with the required precision.

Figure 3:
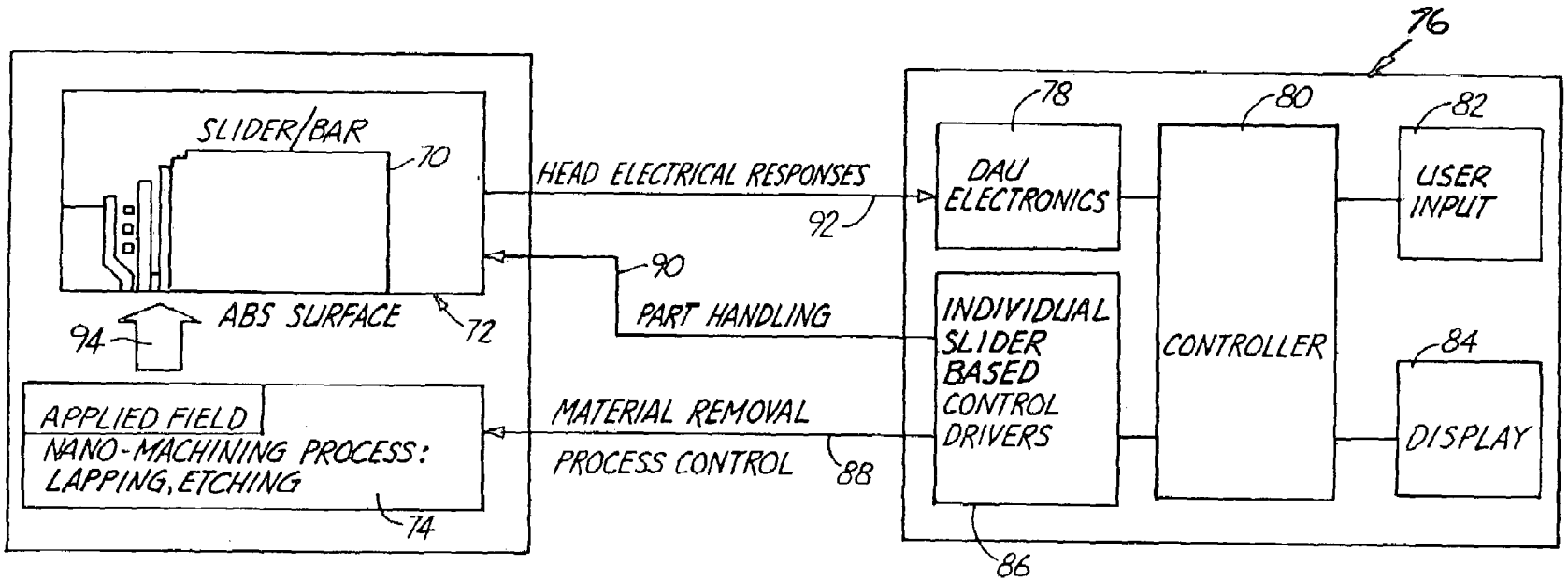
FIG. 3 is a block diagram of a lapping system in accordance with the present invention.

FIG. 3 is a block diagram of a lapping system according to the present invention. Shown in FIG. 3 is a slider 70 having an air bearing surface 72, a material removal device 74, and the control system 76. The control system 76 comprises a data acquisition unit 78, a controller 80, a user input 82, a display 84, and drivers 86 which can be individually controlled for each slider. The control system 76 directs the material removal process with a connection 88 between the material removal device 74 and the control system 76. A parts handling connection 90 connects each slider on the bar 70 to the individual slider based control drivers 86. Feedback from head electrical responses on each slider on the bar 70 is provided to the data acquisition unit 78 by feedback connections 92. A magnetic field, illustrated by arrow 94, is applied to the air bearing surface 72 by the material removal device 74.

The material removal device 74 may comprise any suitable lapping mechanism or process, such as a slurry process, a polishing plate using free abrasives such as alumina or diamond dust, or a polishing plate having an abrasive embedded in the plate. In addition, the material removal device 74 may utilize an etching process.

As the ABS 72 is lapped, a magnetic field 94 is applied to the ABS 72 and a bias current is applied to the reader element on each slider on the bar 70. As the magnetic field 94 is applied, it is possible to directly monitor the MR elements for such electrical response signals as a change in resistance or amplitude through each MR read element. These electrical responses are provided to the data acquisition unit 78 via the feedback connections 92. The controller 80 uses this feedback to form a sensor height profile of the bar 70. The sensor height profile is an indication of the stripe height of each MR element on the bar 70.

Once a sensor height profile is created for the bar 70, the controller 80 controls the control driveres 86 corresponding to each slider on the bar 70 during the material removal process based on the stripe height profile. The controller 80 is configured to control the bending and balancing of the fixture relative to the material removal device 74. The control drivers 86 are further configured to allow individual positioning of each slider 70 relative to the material removal device 74 to precisely control the material removal at each slider 70. For instance, the control drivers 86 may be configured to cause a particular slider on the bar 70 to come into contact with the material removal device 74. As the material removal progresses and the desired target stripe height of the MR element on the slider 70 is reached, the control drivers 86 can be directed to remove the slider 70 from contacting the material removal device 74 so that lapping proceeds more slowly or even stops.

The MR element on each slider 70 can thus be used directly to provide the desired feedback during machining to ensure the desired stripe height is reached on each slider on the bar 70. Electrical parameters of the MR read element, such as amplitude or change in resistance, vary as a function of the magnetic field 94 applied to the MR element. The relationship between the desired electrical parameter and the magnetic field may be known or determined by modeling. Once the relationship is determined, the control system 76 can control the material removal process so that material removal proceeds until the desired stripe height target, as indicated by the resistance change or amplitude, is reached.

Figure 5:
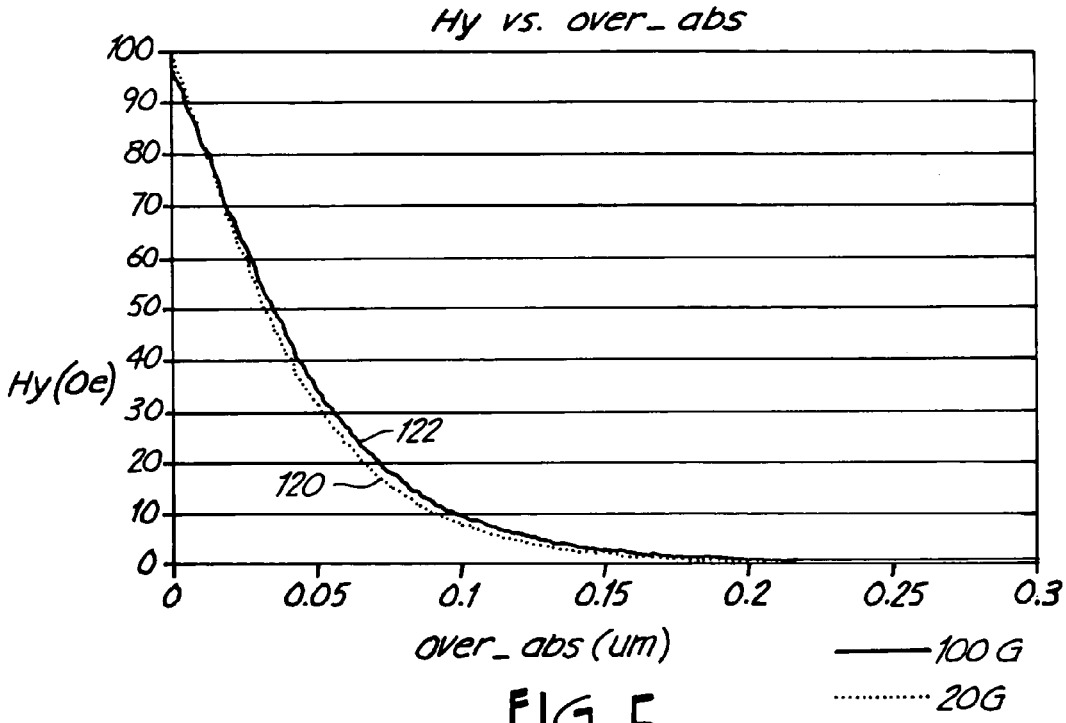
FIG. 5 is a graph illustrating the results of the sensed field by a magnetic read/write transducer as a function of the distance to the air bearing surface.
Figure 4:
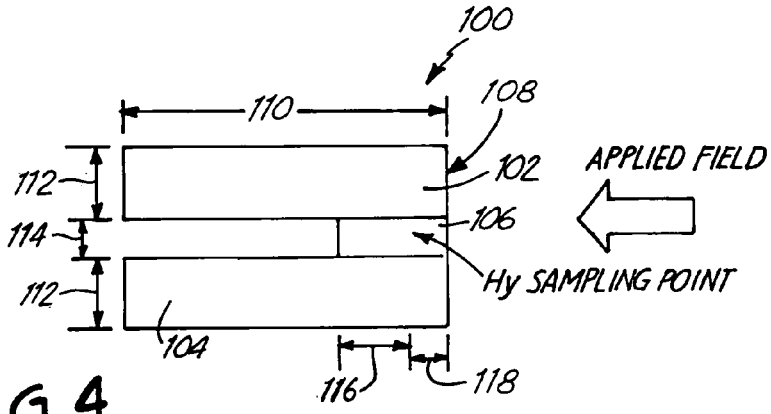
FIG. 4 is a greatly enlarged view of a portion of the MR element.

FIGS. 4 and 5 illustrate modeling results of a magnetic field sensed by an MR element as a function of the stripe height. FIG. 4 is a greatly enlarged view of a portion of the MR element 100. FIG. 5 shows the modeling results of applying a 100 Oe magnetic field to both a head capable of reading a 20 gigabit per square inch ("Gbit/in$^2$") disc and a head capable of reading a 100 Gbit/in$^2$ disc during lapping.

The MR element shown in FIG. 4 has a top shield 102, a bottom shield 104, a MR read element 106, and an air bearing surface 108. When modeling the 20 Gbit/in$^2$ and the 100 Gbit/in$^2$ MR read element, the shield height 110 of the top and bottom shields 102, 104 was about 10 micrometers, while the shield length 112 of the top and bottom shields was about 2 micrometers. The spacing 114 between the top and bottom shield was about 2 micrometers. For the 20 Gbit/in$^2$ head, the sensor height 116 of the MR read element 106 was set at about 0.25 micrometers. For the 100 Gbit/in$^2$ head, the sensor height 116 of the MR read element 106 was set at about 0.1, though it may drop to as little as 0.05 micrometers. In FIG. 4, the amount of material to be removed from the MR element 100 during lapping is indicated as the amount above ABS 118.

The modeling results for both the 20 Gbit/in$^2$ and the 100 Gbit/in$^2$ MR read elements with the above dimensions are shown in FIG. 5. In FIG. 5, the x-axis shows the amount of material on the air bearing surface above the stripe height target, which corresponds to the dimension 118 illustrated in FIG. 4. The y-axis shows the magnetic field sensed by the MR read element in Oerstads. A first curve 120 illustrates the field sensed by the 20 Gbit/in$^2$ head as material removal progresses, while a second curve 122 illustrates the field sensed by a 100 Gbit/in$^2$ head as material removal progresses. In FIG. 5, when the MR read element 106 is able to sense the entire magnetic field of 100 Oe, the amount of material 118 above the ABS, and thus the target stripe height, is 0.

Both curves 120, 122 illustrate that as the material removal process proceeds over the ABS, the strength of the magnetic field sensed by the MR element 106 increases. As material removal progresses, the MR read element eventually is capable of sensing the entire applied magnetic field. Once the MR read element senses the entire applied field, an electrical parameter, such as resistance, will vary as a function of the strength of the magnetic field. In addition to monitoring a resistance change, it is also possible to collect data regarding amplitude of a bias current through the MR read element, or other electrical parameters which vary as a function of an applied field. Using this known relationship between the strength of an applied field and an electrical parameter, the material removal process can be precisely controlled to achieve the desired stripe height.

As can be seen from FIG. 5, the MR read element response to the applied field does not change until material removal has progressed to within 0.2 micrometers of the stripe height target. Because of this, using direct head response signals is most useful to control the final stages of the material removal process. Up to that point, the prior art ELG are still useful for early stage coarse machining control where several micrometers of material must be removed. Furthermore, using direct head electrical feedback during fine machining allows for perfecting process conditions so that head signal to noise ratios and stability can be improved.

The heads on the sliders are extremely sensitive to voltage potential, such as that caused by electrostatic discharge (ESD). Typically, the sliders on the wafer are formed with some form of ESD protection so that the MR elements are not damaged during manufacture or testing of the wafer and sliders. One form of ESD protection is to shunt the MR read element leads to the substrate. In such a situation, the MR read element is unavailable for use process control. However, it may be possible to design non-linear MR elements which are not shunted for ESD protection. As such, the present invention preferably relates to non-linear MR elements which are available for collecting the desired electrical parameters during process control.

Figure 6:
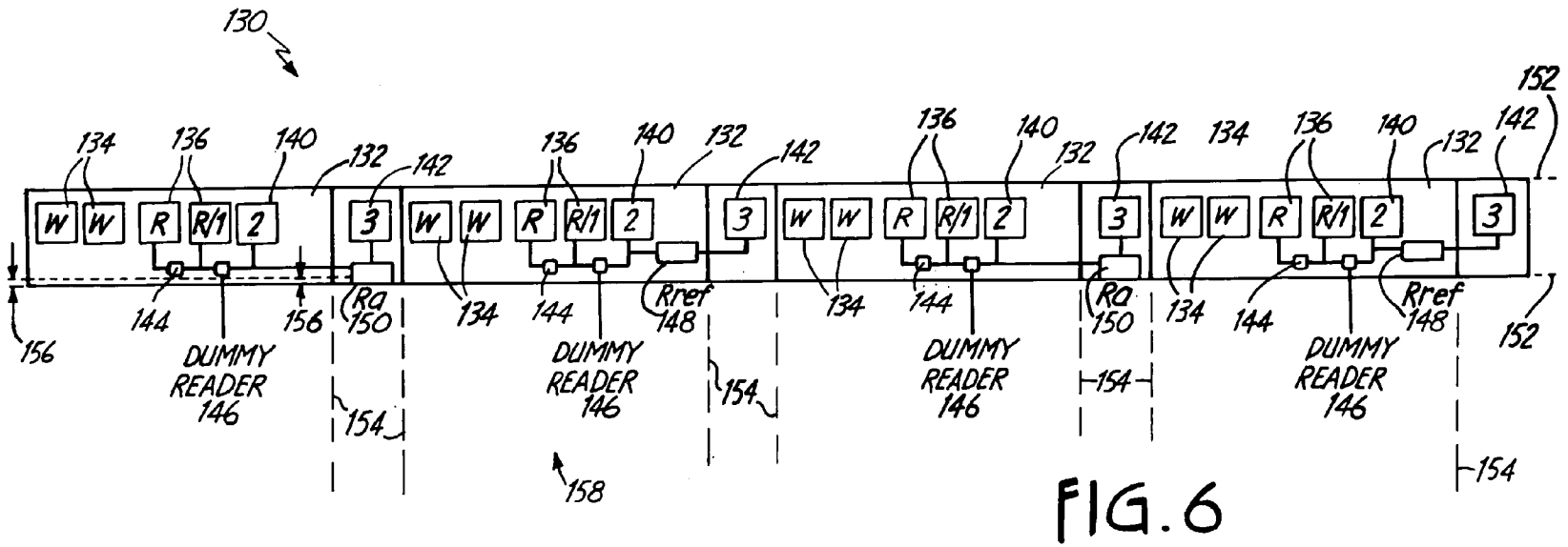
FIG. 6 is a schematic view of an ELG system according to the present invention utilizing a dummy reader.

In cases where non-linear design of the MR element is not possible, one promising form of ESD protection which may be used with the present invention involves the use of a dummy read element. FIG. 6 is a schematic view of a bar of sliders integrating an ELG having a dummy reader for protecting the actual read element from potential damage during final machining and testing. During process control, the dummy reader can be used instead of the actual MR read element.

FIG. 6 shows a bar 130 of four sliders 132. On each slider 132 are two write bond pads 134 and two read bond pads 136. Each slider 132 further has a second bond pad 140. A third bond pad 142 is associated with each slider 132, but is not located on the slider 132. Also on each slider is a MR element 144 and a dummy reader 146. On every other slider 132 there appears a reference resistor $R_{ref}$ 148. Further, associated with every other bond pad 142 is a resistor $R_a$ 150.

The dummy reader 146 and the MR element 144 have identical structure (shields, contacts, leads), are formed of the same material, and are deposited in the same process steps. As a result, the dummy readers 146 are assumed to have the same electrical characteristics as the actual MR elements 144. The dummy readers 146 further allow for ESD shunting of the actual MR elements 144. Thus, ESD shunting of the actual MR elements 144 can be implemented through the dicing lane, illustrated by lines 152, while ESD protection of the dummy reader can be done through the slicing lane, illustrated by lines 154. As a result, the dummy reader 146 is available for electrical connection during final machining and can be used for process control.

During machining, an air-bearing surface 158 is exposed to machining. As lapping proceeds, the height of resistor $R_a$ 150 changes. Just as described with reference to the prior art above, it is possible to use the resistors $R_a$ 150 and $R_{ref}$ 148 to determine a stripe height of the dummy reader 146, and by extension the actual MR element 144 as well.

Similar to the regular ELG scheme described with reference to the prior art above, $R_{ref}$ is used to estimate the local sheet resistance Q:

$$R_{ref} = \frac{QL_{ref}}{W_{ref}}$$

The resulting sensor height is calculated by:

$$SH = \frac{W_{ref} L_a}{L_{ref}} \frac{R_{ref}}{R_a} - \text{Offset}$$

Typical dimensions of the reference resistor $R_{ref}$ are width $W_{ref}$=40 micrometers and length $L_{ref}$=700 micrometers. Typical dimensions of the resistor $R_a$ are width $w_a$=25 micrometers and length $L_a$=70 micrometers. The offset 156 refers to the spacing of the dummy reader 146 relative to the resistor $R_a$ 150 when the two are not located in the same plane.

Depending on the space availability, the ELG elements 150, 148 ($R_a$, $R_{ref}$) and third contact pad 142 may be either on the slider body 132 or on the dicing lane 152. In addition, it is not necessary for the real reader 144 and the dummy reader 146 to share a contact pad.

Although the present invention has been described with reference to preferred embodiments, workers skilled in the art will recognize that changes may be made in form and detail without departing from the spirit and scope of the invention.

The invention claimed is:

1. A material removal device comprising:

a plurality of sliders;

a sensor associated with each slider, each sensor configured to communicate an electrical response based on the application of an external magnetic field, the electrical response changing as a function of height of the sensor;

a fixture for holding the plurality of sliders;

a lapping mechanism for lapping a surface of the sliders;

a plurality of control drivers, wherein each slider has an associated control driver for individually adjusting each slider relative to the lapping mechanism; and a control system for controlling lapping of the sliders by controlling the plurality of control drivers based on input received from the sensor associated with each slider.

2. The material removal device of claim 1 wherein the sensor is a first magnetoresistive element.

3. The material removal device of claim 1 wherein the sensor is a linear magnetoresistive sensor.

4. The material removal device of claim 1 wherein the plurality of sliders comprises a bar of sliders.

5. The material removal device of claim 4 wherein the control system controls lapping of the bar based on a height profile of the bar obtained from the sensor associated with each slider.

6. The material removal device of claim 2 wherein the sensor associated with each slider comprises a second magnetoresistive element on each slider.

7. A material removal device comprising:

a plurality of sliders;

a lapping mechanism for lapping a surface of each of the sliders;

a control system comprising:

a magnetic field source for applying a magnetic field, at least one sensor on each of the sliders, wherein the at least one sensor is configured to communicate an electrical response based on the magnetic field which varies as a function of a height of each sensor, and control software for correlating the communicated electrical responses to a target dimension for each slider; and a mechanism for individually removing each slider from the lapping mechanism when the target dimension for each slider is attained.

8. The material removal device of claim 7 wherein the mechanism for individually removing each slider from the lapping mechanism comprises:

a plurality of control drivers associated with each slider; and a control system for controlling the control drivers during lapping based on the electrical response and the target dimension.

9. The material removal device of claim 7 wherein the at least one sensor is a magnetoresistive element.

10. The material removal device of claim 7 wherein the at least one sensor is a second magnetoresistive element.

11. A material removal device for lapping a plurality of sliders, the material removal device comprising:

a lapping mechanism for lapping a surface of the sliders;

a first magnetoresistive element and a second magnetoresistive element associated with each slider, the second magnetoresistive element configured to sense a parameter related to a target dimension; and a mechanism for individually removing each slider from the lapping mechanism when the target dimension for that slider is attained.

12. A material removal device for lapping a plurality of sliders, the material removal device comprising:

a fixture for holding the plurality of sliders;

a lapping mechanism for lapping a surface of the sliders;

a first magnetoresistive element on each slider configured to sense magnetic fields during operation;

a second magnetoresistive element on each slider configured to sense a parameter related to a height of a magnetoresistive element on each slider;

a plurality of control drivers, wherein each slider has an associated control driver for individually adjusting each slider relative to the lapping mechanism; and a control system for controlling lapping of the sliders by controlling the plurality of control drivers based on the sensed parameters.

13. The material removal device of claim 11, wherein the parameter is related to a height of the second magnetoresistive element.

14. The material removal device of claim 11, and further comprising a control system for controlling lapping of the sliders based on input received from the second magneto resistive element associated with each slider.

15. The material removal device of claim 14, wherein the input received is based on a height profile.

16. The material removal device of claim 14, wherein the plurality of sliders comprises a bar of sliders.

17. The material removal device of claim 16, wherein the control system controls lapping on the bar based on a height profile of the bar obtained form the second magnetoresistive element associated with each slider.

18. The material removal device of claim 12, wherein the plurality of sliders comprises a bar of sliders and wherein the control system controls lapping on the bar based on a height profile of the bar obtained form the second magnetoresistive element associated with each slider.

19. The material removal device of claim 12, wherein the parameter related to a height of a magnetoresistive element on each slider is change in resistance.

20. The material removal device of claim 12, wherein the parameter related to a height of a magnetoresistive element on each slider is amplitude.

21. The material removal device of claim 12, wherein the control system comprises:

a magnetic field source for applying a magnetic field; and control software for correlating the sensed parameters to a target dimension for each slider.

* * * * *

UNITED STATES PATENT AND TRADEMARK OFFICE

CERTIFICATE OF CORRECTION

PATENT NO. : 7,147,539 B1
APPLICATION NO. : 09/864562
DATED : December 12, 2006
INVENTOR(S) : Shanlin Hao et al.

It is certified that error appears in the above-identified patent and that said Letters Patent is hereby corrected as shown below:

Column 1, Line 46, delete “the-same”, insert --the same--

Signed and Sealed this

Third Day of April, 2007

JON W. DUDAS
*Director of the United States Patent and Trademark Office*